United States Patent [19]

Bortz et al.

[11] Patent Number: 4,952,303

[45] Date of Patent: Aug. 28, 1990

[54] PROCESS FOR PREPARING A VERY HIGH QUALITY LUBE BASE STOCK OIL

[75] Inventors: Robert W. Bortz, Woodbury Heights, N.Y.; Kenneth R. Graziani, Woodbury, N.J.

[73] Assignee: Mobil Oil Corp., New York, N.Y.

[21] Appl. No.: 289,341

[22] Filed: Dec. 22, 1988

Related U.S. Application Data

[63] Continuation-in-part of Ser. No. 173,389, Mar. 25, 1988, abandoned, which is a continuation of Ser. No. 753,478, Aug. 10, 1985, abandoned.

[51] Int. Cl.[5] ..... C10G 45/08; C10G 67/04; C10G 45/50

[52] U.S. Cl. ..... 208/216 R; 208/18; 208/27; 208/33; 208/143; 208/254 H

[58] Field of Search ..... 208/27, 33, 216 K, 254 H, 208/144, 143, 18

[56] References Cited

U.S. PATENT DOCUMENTS

| | | | |
|---|---|---|---|
| Re. 28,398 | 4/1975 | Chen et al. | 208/111 |
| 3,224,955 | 12/1965 | Anderson | 208/33 |
| 3,617,475 | 11/1971 | Offutt et al. | 208/33 |
| 3,619,414 | 11/1971 | Mills et al. | 208/143 |
| 3,663,423 | 5/1972 | Bennett et al. | 208/59 |
| 3,668,113 | 6/1972 | Burbidge et al. | 208/97 |
| 3,755,138 | 8/1973 | Chen et al. | 208/33 |
| 3,773,650 | 11/1973 | Hislop et al. | 208/33 |
| 3,880,746 | 4/1975 | Bennett et al. | 208/59 |
| 3,894,938 | 7/1975 | Gorring et al. | 268/27 |
| 3,956,102 | 5/1976 | Chen et al. | 208/93 |
| 3,959,122 | 5/1976 | Mills et al. | 208/143 |
| 4,137,148 | 1/1979 | Gillespie et al. | 208/87 |
| 4,162,962 | 7/1979 | Strangeland | 208/97 |
| 4,259,170 | 3/1981 | Graham et al. | 208/33 |
| 4,283,271 | 8/1981 | Garwood et al. | 208/59 |
| 4,437,975 | 3/1984 | Gillespie et al. | 208/87 |

*Primary Examiner*—Paul E. Konopka
*Attorney, Agent, or Firm*—Alexander J. McKillop; Charles J. Speciale

[57] ABSTRACT

A process for obtaining a very high quality lube base stock is disclosed which comprises:

(a) introducing an aromatic and nitrogen-and sulfur-containing feedstock selected from the group consisting of a dewaxed oil obtained from refining distillate fraction and having a 60–700 SUS at 100° F. and a dewaxed oil obtained from refining vacuum resid and having a 2300–2700 SUS at 100° F., and hydrogen, into a single stage hydrotreating reactor; and, (b) subjecting the feedstock to hydrotreating in said reactor in the presence of a sulfided cobalt/molybdenum hydrotreating catalyst at an average reactor temperature of from about 550° to about 700° F. at a hydrogen partial pressure of from about 1500 to about 3000 psia at the reactor outlet, an LHSV of from about 0.1 to about 1.00 and a hydrogen circulation rate of from about 300 SCF to about 2500 SCF per barrel to provide a very high quality lube base stock in which the aromatic, nitrogen and sulfur content is substantially reduced, and requiring no subsequent adsorbent treatment.

16 Claims, No Drawings

PROCESS FOR PREPARING A VERY HIGH QUALITY LUBE BASE STOCK OIL

BACKGROUND OF THE INVENTION

The present application is a continuation-in-part of U.S. patent application Ser. No. 173,389 filed Mar. 25, 1988, now abandoned which in turn is a continuation of U.S. patent application Ser. No. 753,478 filed Aug. 10, 1985, now abandoned.

The invention relates to the manufacture of high grade viscous oil products from crude petroleum fractions. It is particularly directed to the manufacture of very high quality lube base stock oils from crude stocks of high wax content, commonly classified as "wax base" in contrast to "naphthenic base" crudes. The latter crudes are relatively lean in straight chain paraffins and yield viscous fractions which inherently possess low pour points.

Lube base stock oils are conventionally prepared by refining distillate fractions or the residuum prepared by vacuum distilling a suitable crude oil from which the lighter portion has been removed by distillation in an atmospheric tower. Thus, the charge to the vacuum tower is commonly referred to as an atmospheric resid or reduced crude, and the residuum from the vacuum tower is distinguished from the starting material by referring to it as the vacuum resid.

The vacuum distillate fractions are upgraded by a sequence of unit operations, the first of which is solvent extraction with a solvent selective for aromatic hydrocarbons. This step serves to remove aromatic hydrocarbons of low viscosity index and provides a raffinate of improved viscosity index and quality. Various processes have been used in this extraction stage employing solvents such as furfural, phenol, sulfur dioxide, and others. The vacuum resid, because it contains most of the asphaltenes of the crude oil, is conventionally treated to remove these asphalt-like constituents prior to solvent extraction to increase the viscosity index.

The raffinate from the solvent extraction step contains paraffins which adversely affect the pour point. Thus, the waxy raffinate, regardless of whether prepared from a distillate fraction or from a vacuum resid, must be dewaxed. Various dewaxing procedures have been used and the art has gone in the direction of treatment with a solvent such as MEK/toluene mixtures and/or catalytic dewaxing to remove the wax and provide a dewaxed oil. The dewaxed raffinate may then be finished by any of a number of sorption or catalytic processes to improve color and oxidation stability, e.g., clay percolation or hydrofinishing.

The quality of the lube base stock oil prepared by the sequence of operations outlined above depends on the particular crude chosen as well as the severity of treatment for each of the treatment steps. Additionally, the yield of a high quality lube base stock oil also depends on these factors and, as a rule, the higher the quality sought, the less the yield. In general, naphthenic crudes are favored because less loss is encountered, particularly in the dewaxing step. In many cases, however, waxy crudes are more readily available, and it would be desirable to provide a process for preparing very high quality lube base stock in good yields from such waxy crude oils.

In recent years techniques have become available for the catalytic dewaxing of petroleum stocks. U.S. Pat. No. Re. 28,398 describes a process for catalytic dewaxing employing a catalyst comprising zeolite ZSM-5. Such a process combined with catalytic hydrofinishing is described in U.S. Pat. No. 3,894,938 to Gorring, et al.

U.S. Pat. No. 3,894,938 to Gorring, et al. describes a process for the catalytic dewaxing of gas oils to low pour point fuels such as Diesel fuel and No. 2 or home heating fuel which utilizes a hydrodesulfurization by contact with a cobalt-molybdenum-alumina catalyst so that sulfur is converted to hydrogen sulfide and nitrogen is converted to ammonia. This process, however, has nothing to do with lubricating oils and is concerned exclusively with the manufacture of fuels.

U.S. Pat. No. 3,224,955 to Anderson describes a process for making a lubricating oil for refrigeration units in which a straight-run mineral oil distillate is first subjected to an aromatic extraction process with a solvent such as furfural whereby the polyaromatic content is reduced to less than 8% by weight, followed by dewaxing. The dewaxed raffinate is subjected to a mild hydrodesulfurization wherein sulfur and oxygen compounds are hydrogenated while the hydrocarbons remain substantially unaffected, i.e. virtually no cracking of the oil or hydrogenation of aromatics present in the oil. The hydrogenation is carried out at a temperature of 550° to 700° F., a pressure of 450 to 1500 psig, a gas discharge rate of 250–1200 standard cubic feet of hydrogen per barrel of oil, and a liquid hourly space velocity of about 1 to 4. Under the mild conditions, hydrogen consumption will be about 20–250 standard cubic feet/barrel of oil and sulfur removal will be about 50–75% complete. Anderson further discloses that more severe hydrogenation, i.e. low space velocities, high pressures and high temperatures, would increase sulfur and nitrogen removal, hydrogenation of aromatics, and hydrogen consumption, but does not suggest what these conditions might be. Because little or no nitrogen compounds are removed in its desulfurization, Anderson requires contacting the hydrotreated oil with a solid adsorbent for denitrification.

The present invention accomplishes dearomatization and removal of sulfur and nitrogen in an efficient, single hydrotreating step. The charge stock which is to be hydrotreated may contain considerably higher amounts of aromatics than Anderson, and no adsorbent treatment of the hydrotreated oil is necessary.

U.S. Pat. No. 4,437,975 to Gillespie describes a process for preparing a lube base stock oil from a vacuum resid by catalytically dewaxing the vacuum resid over a zeolite catalyst such as ZSM-5 and cascading the entire effluent, including hydrogen, into a hydrotreating reactor operated under relatively mild conditions, i.e., at a temperature from about 500° to about 675° F. and at a hydrogen partial pressure at the reactor inlet of about 150–1500 psia. Under these conditions, the olefins present in the dewaxed feed stock are substantially hydrogenated thereby eliminating a principal source of oxidative and thermal instability. These hydrotreating conditions are not severe enough, however, to effect any appreciable reduction in the content of aromatic compounds and nitrogen-and sulfur-containing compounds the presence of which limits the use of the resulting oils to relatively undemanding service applications.

U.S. Pat. No. 3,959,122 describes a process for producing a technical white oil having an ultraviolet absorptivity in the 280–289 millimicron region of less than 2.0 and having a viscosity in the range of 300–600 SUS (Saybolt Universal Seconds) at 100° F. in which a paraffinic distillate having a viscosity in the range of 400–600 SUS is hydrorefined at a temperature of 550°–600° F., at a hydrogen partial pressure in the range of 800–3000 psi and a total pressure in the range of 800–6000 psig in the presence of a sulfided nickel/molybdenum hydrogenation catalyst and at a liquid hourly space velocity (LHSV) of 0.1 to 1.0. Under these hydrorefining conditions, a significant reduction in aromatic, nitrogen and sulfur content occurs providing a very high quality oil which is suitable for demanding lubrication applications, e.g., as turbine oils.

It is an object of this invention to provide a process for preparing a very high quality lube base stock oil having excellent thermal and oxidation stability from a waxy crude oil.

It is a further object to provide a very high quality lube base stock in which the aromatic, nitrogen, and sulfur content is substantially reduced.

It is yet another object of the present invention to provide a process whereby charge stocks with initially high levels of aromatics, sulfur, and nitrogen can be treated to produce high quality lube base stock so that a reduction in solvent extraction severity can be used initially and no subsequent adsorbent treatment is necessary.

SUMMARY OF THE INVENTION

The present invention utilizes process conditions which essentially remove sulfur, nitrogen and polynuclear aromatic components.

These objects are achieved by the process which comprises:

(a) introducing aromatics-, nitrogen- and sulfurcontaining feedstock selected from the group consisting of a dewaxed oil obtained from refining distillate fraction and having a 60–700 SUS at 100° F. and a dewaxed oil obtained from refining vacuum resid and having a 2300–2700 SUS at 100° F., and hydrogen, into a single stage hydrotreating reactor; and, (b) subjecting the feedstock to hydrotreating in said reactor in the presence of a sulfided cobalt/molybdenum hydrotreating catalyst at an average reactor temperature of from about 550° to 700° F. at a hydrogen partial pressure of from about 1500 to about 3000 psia at the reactor outlet, an LHSV of from about 0.1 to about 1.0 and a hydrogen circulation rate of from about 300 SCF to about 2500 SCF per barrel to provide a very high quality lube base stock in which the aromatic, nitrogen, and sulfur content is substantially reduced.

The use of a sulfided cobalt/molybdenum catalyst provides several advantages over a sulfided nickel/-molybdenum catalyst as used in the hydrorefining process of U.S. Pat. No. 3,959,122 referred to above. Thus, the greater stability of a cobalt/molybdenum catalyst compared to that of a nickel/molybednum catalyst permits the former to be regenerated at a higher temperature and correspondingly shorter period of time than the latter thereby reducing reactor down-time and increasing productivity. In addition, the greater stability of the cobalt/molybdenum catalyst makes it more suitable for steam/air regeneration which is less expensive than the nitrogen/air regeneration methods more commonly employed with nickel/molybdenum catalysts. Moreover, cobalt/molybdenum is significantly easier to sulfide/presulfide, the form in which the catalyst must be used in the hydrotreating process herein. These advantages result in an overall superior hydrotreating operation compared to one employing a nickel/molybdenum catalyst.

Known unit processes are applied to distillate or vacuum resid fractions of waxy crude in particular sequence and within limits to prepare lube base stock oils used, for example, in hydraulic fluids, motor oils, turbine oils, marine oils and gear lubricants. The first step after preparation of a distillate fraction of suitable boiling range is extraction with a solvent which is selective for aromatic hydrocarbons, e.g., furfural, phenol, n-methylpyrrolidone, or others, to remove undesirable components of the fraction. With a vacuum resid fraction, it is required to propane deasphalt the resid prior to solvent extraction. In some instances, such as with a cylinder stock, solvent extraction of the deasphalted vacuum resid can be omitted. When a solvent extraction is used in the present invention, it can be relatively mild since the present process is suitable for treating charge stocks containing relatively high levels of aromatics. The raffinate from solvent extraction or propane deasphalting of vacuum resid is then dewaxed in a conventional manner, e.g., by treatment with a solvent such as MEK/toluene, propane or catalytically in the presence of hydrogen over a catalyst of an aluminosilicate zeolite having a silica to alumina ratio greater than 12 and a constraint index of 1 to 12 or by a combination of solvent and catalytic dewaxing as in U.S. Pat. No. 3,755,138. The dewaxed oil is then hydrotreated in a single stage hydrotreating unit in the presence of sulfided cobalt/molybdenum catalyst operated under the foregoing specified conditions to provide a white oil possessing substantially improved color, demulsibility and oxidation stability and ideally suited for severe service applications such as turbine oils. The hydrotreated product is thereafter distilled, i.e. topped by distillation, to separate low boiling products of dewaxing in order to meet physical property specifications such as flash point and others. Conducting the unit processes at the conditions more fully specified hereinafter imparts higher quality characteristics to the lube base stock oils and at the same time produces high yields of finished oils.

DESCRIPTION OF THE PREFERRED EMBODIMENTS

The wax base crudes (sometimes called "paraffin base") from which the charge stock is derived by distillation constitute a well recognized class of crude petroleums. Many scales have been devised for classification of crude, some of which are described in Chapter VII Evaluation of Oil Stocks of "Petroleum Refinery Engineering", W. L. Nelson, McGraw-Hill, 1941. A convenient scale identified by Nelson at page 69 involves determination of the cloud point of the Bureau of Mines "Key Fraction No. 2" which boils between 527° and 572° F. at 40 mm pressure. If the cloud point of this fraction is above 5° F., the crude is considered to be a wax base.

Known and conventional solvent extraction by counter current extraction with at least an equal volume (100 vol. %) of a selective solvent such as furfural is contemplated. It is preferred to use from about 1.5 to about 4.0 volumes of solvent per volume of oil. The furfural raffinate product is thereafter subjected to any one of several known and conventional solvent and/or catalytic dewaxing procedures.

Solvent dewaxing is a well known technique and needs no detailed description here. In general, the raffinate from the solvent refining unit is combined with a selective solvent and chilled to the appropriate temperature to crystallize the wax which is then separated therefrom. Representative examples of suitable solvents are (a) the aliphatic ketones having from 3 to 6 carbon atoms such as acetone, methyl ethyl ketone (MEK) and methyl isobutyl ketone (MIBK) and (b) propane, butane, and propylene as well as mixtures of the foregoing ketones and mixtures of the aforesaid ketones with aromatic compounds such as benzene and toluene. In addition, halogenated low molecular weight hydrocarbons such as the $C_2$–$C_4$ chlorinated hydrocarbons, e.g., dichloromethane and dichloroethane and mixtures thereof, can be used as solvents,. Specific examples of suitable solvent mixtures are methyl ethyl ketone and methyl isobutyl ketone, methyl ethyl ketone and toluene, dichloromethane and dichloroethane and propylene and acetone. The raffinate is dewaxed by the selected solvent or solvent mixture which is adjusted to the composition of the charge stock to meet specifications for the particular lube base stock and the contemplated end-use, such being determined in accordance with well established practices.

In a preferred catalytic dewaxing procedure, the waxy raffinate from the solvent extraction operation is mixed with hydrogen and contacted at 500°–674° F. with a catalyst containing a zeolite ZSM-5 or other aluminosilicate zeolite having a silicate/alumina ratio above 12 and a constraint index of 1–2, with or without a hydrogenation component, and at an LHSV of 0.1 to 2.0 volumes of charge oil volume of catalyst per hour. The preferred space velocity is 0.5 to 1.0 LHSV. The catalytic dewaxing reaction produces olefins which would impair properties of the dewaxed oil product if retained. These are saturated by hydrogenation in the hydrotreating reactor. The saturation reaction is evidenced by the temperature rise in the bottom portion of the reactor, and confirmed by chemical analysis of the feed and hydrotreated product. By this means, it is possible to prepare stable very high quality lube base stock oils having pour points even below −65° F.

In some instances it may be desirable to partially dewax the charge stock to the catalytic dewaxing unit by conventional solvent dewaxing techniques as described above, say to a pour point of from 10° F. to about 50° F. The higher melting point waxes so removed are those of higher market value than the waxes removed in conventionally taking the product to a still lower point below 10° F.

The cracked (and hydrogenated) fragments from cracking wax molecules in the catalytic dewaxer will have adverse effects on the flash point of the dewaxed raffinate product and are therefore removed by distillation of the product to flash point specifications.

In the process of this invention, effluent from the solvent or catalytic dewaxing step (or sequential solvent/catalytic dewaxing operations) is introduced into a conventional fixed bed single stage hydrotreating reactor containing a sulfided/molybdenum catalyst on a support, e.g., one of alumina. Such catalysts are well known in the art and are commercially available. Shell's S-344 catalyst, a 1/16 inch pelletized extrudate of sulfided cobalt (2.4 wt. %) and molybdenum (9.8 wt. %) on alumina having a surface area of 190 $m^2$/gm and a pore volume of 0.56 cc/gm has been found to provide entirely acceptable results.

The hydrotreating reactor is operated at an average reactor bed temperature of from about 550° to 700° F., preferably from about 600° to about 650° F., a hydrogen partial pressure of from about 1,500 to about 3,000 psia, preferably from about 2,000 to about 2,500 psia, at the reactor outlet, an LHSV of from about 0.1 to about 1.0, preferably from about 0.3 to about 0.6, and a hydrogen circulation rate of from about 300 to about 2,500, preferably from about 500 to about 2,000 SCF per barrel, and most preferably from about 1,000 to about 2,000 SCF per barrel.

The effluent from the hydrotreating reactor is steam-stripped to remove the most volatile components and thereby meet flash point and other product specifications.

The hydrotreating reactor conditions are important in achieving the removal of sulfur, nitrogen, and polyaromatics, since removal of each of the three is affected by different factors. For example, sulfur removal is favored by higher temperature and lower space velocity, and nitrogen and aromatics removal requires that conditions of the present invention to be within the stated parameters. A careful control of reactor conditions is necessary to achieve the essentially complete removal of all three and yet yield a product with improved viscosity index.

In a preferred aspect of this invention, the feedstock to be introduced into the hydrotreating reactor contains high levels of polyaromatics, nitrogen, and sulfur. The polyaromatics may be above about 9%, and as high as about 15%–20% by wt.; the nitrogen above about 30 ppm, e.g. from about 30 ppm to about 50 ppm, and even above 50 ppm; and the sulfur may be above about 1000 ppm, e.g. from about 1000 ppm to about 1500 ppm, or even above about 1500 ppm.

The following examples are illustrative of the process of this invention.

As these data show, in each case, the sulfur, nitrogen and aromatic content of the charge stock was substantially reduced providing very high quality lube base stock oils ("technical grade white oils") possessing much improved color and oxidation stability. The hydrotreated oils were entirely suitable for use as turbine oils.

The process is highly effective even with charge stock with high levels of polyaromatics, sulfur and nitrogen. The process conditions were selected to essentially remove sulfur, nitrogen, polyaromatics and minimize the total aromatics level in the lube base stock. Operation at lower hydrogen partial pressure may not reduce sulfur, nitrogen and total aromatics to the desired level. Operation at conditions not within the ranges of the present invention (e.g. above 700° F. average reactor temperature) can result in the formation of undesirable poly-nuclear aromatics (PNA's) and decreased product stability.

EXAMPLE 1

An automotive grade furfural-extracted oil derived from a North Sea crude (Statfjord) which was dewaxed in a conventional manner employing a 65/35 toluene/-MEK mixture was charged to a fixed bed single stage hydrotreating reactor of known construction loaded with Shell's S-344 sulfided cobalt/molybdenum on alumina hydrotreating catalyst.

The data for the conditions of the hydrotreating operation, the characteristics of the charge stock and the properties of the resulting hydrotreated oil in five separate cases are set forth in Table 1 as follows:

TABLE 1

Hydrotreating Conditions of Solvent Dewaxed Charge Stock and Properties of Resulting Hydrotreated Oil

| Hydrotreating Conditions | Charge Stock | Case 1 | Case 2 | Case 3 | Case 4 | Case 5 |
|---|---|---|---|---|---|---|
| Average reactor temp., °F. | — | 650 | 650 | 675 | 600 | 600 |
| LHSV, $hr^{-1}$ | — | 0.3 | 0.6 | 0.5 | 0.5 | 0.3 |
| Hydrogen circ., SCF/B | — | 1261 | 609 | 767 | 717 | 1186 |
| Hydrogen partial pressure (inlet), psig | — | 2461 | 2200 | 2357 | 2406 | 2457 |
| Properties of Oil[1] | | | | | | |
| Sp Gr | 0.875 | 0.867 | 0.869 | 0.868 | 0.872 | 0.870 |
| Viscosity | | | | | | |
| KV Viscosity at 40° C. | 61.25 | 50.87 | 56.22 | 49.99 | 59.42 | 58.31 |
| KV at 100° C. | 8.03 | 7.27 | 7.67 | 7.20 | 7.90 | 7.82 |
| SUS at 100° C. | 317 | 263 | 291 | 258 | 308 | 302 |
| SUS at 210° F. | 53 | 51 | 52 | 50 | 53 | 53 |
| Viscosity Index | 96.7 | 101.3 | 99.2 | 102.3 | 97.6 | 98.0 |
| Pour Point, °C. | −12 | −11 | −11 | −11 | −12 | −12 |
| Cloud Point, °C. | −6 | −7 | −7 | −4 | −8 | −6 |
| Flash, °C. | 240 | 222 | 232 | 226 | 236 | 238 |
| Sulfur, ppm | 1900 | 3 | 7 | 2 | 55 | 22 |
| Nitrogen, ppm | 64 | <0.2 | <0.2 | 2.0 | <0.2 | <0.2 |
| UV Absorbance | | | | | | |
| 400 nm ($\times 10^{-5}$) | 79 | 0.56 | 1.4 | 2.3 | 0.50 | 0.2 |
| 325 nm ($\times 10^{-3}$) | 32 | 0.35 | 1.5 | 1.4 | 1.2 | 0.4 |
| 275 nm ($\times 10^{-1}$) | 4.5 | 0.26 | 1.7 | 1.2 | 2.1 | 1.4 |
| 254 nm | 0.67 | 0.03 | 0.13 | 0.03 | 0.14 | 0.09 |
| 226 nm | 3.15 | 0.20 | 1.37 | 0.94 | 1.60 | 1.34 |
| Total Aromatics, wt % | 16.5 | 4.3 | 5.7 | 3.8 | 7.2 | 9.7 |
| Poly-Aromatics, wt % | 7.2 | — | — | — | — | — |
| OCST[2] (3 days at 150° C.) | D8 | 2.5 | 3.0 | <3.0 | 2.5 | 2.0 |
| RBOT[3], min | 325 | 440 | 375 | 425 | 365 | 380 |
| TOST[4], hrs | 1860 | 5250 | — | 5385 | — | 3640 |

[1]The properties of the hydrotreated products were measured following steam stripping to remove volatiles.
[2]OCST - Oven Color Stability Test
[3]RBOT - Rotating Bomb Oxidation Test
[4]TOST - Turbine Oil Stability Test

EXAMPLE 2

A high severity furfural-extracted distillate derived from a North Sea crude (Statfjord) which was subsequently dewaxed in a conventional manner with a 65/35 toluene/MEK mixture was subjected to hydrotreatment in the reactor and with the hydrotreating catalyst of Example 1 with the results (four cases) set forth in Table 2 as follows:

TABLE 2

Hydrotreating Conditions of Solvent Dewaxed Charge Stock and Properties of Resulting Hydrotreated Oil

| Hydrotreating Conditions | Charge Stock | Case 1 | Case 2 | Case 3 | Case 4 |
|---|---|---|---|---|---|
| Average Reactor temp., °F. | — | 652 | 649 | 600 | 603 |
| LHSV, $hr^{-1}$ | — | 0.31 | 0.57 | 0.57 | 0.34 |
| Hydrogen circ., SCF/B | — | 1190 | 630 | 620 | 1030 |
| Hydrogen partial pressure (inlet), psig | — | 2480 | 1990 | 2180 | 2470 |
| Properties of Oil[1] | | | | | |
| Sp Gr | 0.868 | 0.863 | 0.865 | 0.867 | 0.866 |
| Viscosity | | | | | |
| KV at 40° C. | 56.8 | 48.2 | 52.3 | 55.4 | 54.6 |
| KV at 100° C. | 7.81 | 7.16 | 7.50 | 7.74 | 7.68 |
| SUS at 100° F. | 292 | 248 | 270 | 286 | 282 |
| SUS at 210° F. | 52 | 50 | 51 | 52 | 52 |
| Viscosity Index | 102.7 | 107.2 | 105.1 | 103.5 | 104.1 |
| Pour Point, °C. | −12 | −10 | −10 | −10 | −10 |
| Cloud Point, °C. | −8 | −8 | −6 | −8 | −7 |
| Flash, °C. | 242 | 222 | 236 | 238 | 242 |
| Sulfur, ppm | 1150 | 1 | 4 | 30 | 13 |
| Nitrogen, ppm | 36 | <0.2 | <0.2 | <0.2 | <0.2 |
| RI at 70° C. | 1.4585 | 1.4547 | 1.4561 | 1.4574 | 1.4568 |
| UV Absorbance | | | | | |
| 400 nm ($\times 10^{-6}$) | 1740 | 6.90 | 17.0 | 6.60 | 3.20 |
| 325 nm ($\times 10^{-4}$) | 403 | 313 | 11.8 | 9.99 | 3.15 |
| 275 nm ($\times 10^{-2}$) | 38.2 | 2.40 | 6.45 | 10.9 | 9.12 |
| 254 nm ($\times 10^{-1}$) | 4.21 | 0.11 | 0.36 | 0.66 | 0.54 |
| 288 nm | 2.38 | 0.29 | 0.68 | 1.13 | 0.88 |
| Total Aromatics, wt % | 10.8 | 1.9 | 4.6 | — | 5.7 |
| Poly Aromatics, wt % | 4.2 | — | — | — | — |
| OCST | D8 | 2.5 | 3.5 | <3.5 | <3.0 |

TABLE 2-continued

| Hydrotreating Conditions of Solvent Dewaxed Charge Stock and Properties of Resulting Hydrotreated Oil | | | | | |
|---|---|---|---|---|---|
| Hydrotreating Conditions | Charge Stock | Case 1 | Case 2 | Case 3 | Case 4 |
| RBOT | 360 | 390 | 370 | 420 | 460 |
| TOST | 4100 | 7060+ | — | — | 6590 |
| Yield, vol. % | — | 95.6 | 97.2 | 97.9 | 96.0 |

[1]The properties of the hydrotreated products were measured following steam stripping to remove volatiles.

The lube base stock oil product in each of the four cases was a technical grade white oil of very high quality which is well suited for use as a turbine oil.

EXAMPLE 3

This example illustrates the process of the present invention employing the reactor and catalyst of Example 1 but employing as the charge stock, a catalytically dewaxed solvent-extracted distillate of 200 SUS at 100° F. derived from a Mexican crude (Isthmus). The conditions of hydrotreatment, the properties of the charge stock and the properties of the hydrotreated oil (following steam stripping to remove volatiles) are set forth in Table 3 as follows:

TABLE 3

| Hydrotreating Conditions of Catalytically Dewaxed 200 SUS Isthmus Charge Stock And Properties of Resulting Hydrotreated Oil | | |
|---|---|---|
| Hydrotreating Conditions | Charge Stock | Run |
| Average Reactor temp. °F. | — | 650 |
| LHSV, $hr^{-1}$ | — | 0.3 |
| Hydrogen circ., SCF/B | — | 215 |
| Hydrogen partial pressure (inlet), psig | | 2480 |
| Properties of Oil | | |
| Viscosity | | |
| KV at 40° C. | 39.07 | 32.41 |
| KV at 100° C. | 6.017 | 5.43 |
| SUS at 1200° F. | 202 | 167 |
| SUS at 210 F. | 46 | 45 |
| Viscosity Index | — | 103.7 |
| Pour Point, °C. | — | −8 |
| Cloud Point, °C. | — | −6 |
| Flash, °C. | — | 204 |
| Sulfur, ppm | 3100 | 2 |
| Nitrogen, ppm | 40 | <0.2 |
| UV Absorbance | | |
| 275 nm ($\times 10^{-2}$) | 113 | 5.2 |
| 325 nm ($\times 10^{-4}$) | 1230 | 7.2 |
| 400 nm ($\times 10^{-5}$) | 111 | 1.5 |
| Total Aromatics, wt % (by UV) | 24.0 | 3.5 |

TABLE 3-continued

| Hydrotreating Conditions of Catalytically Dewaxed 200 SUS Isthmus Charge Stock And Properties of Resulting Hydrotreated Oil | | |
|---|---|---|
| Hydrotreating Conditions | Charge Stock | Run |
| Poly-Aromatics, wt. % | 9.2 | — |
| OCST | D8 | <2.0 |
| RBOT | 305 | 445 |
| TOST | 2200 | 6400 |

The hydrotreated oil was of technical white oil grade and is well suited for use as a turbine oil.

This example shows that the present invention can be used to effectively process feeds with high levels of polyaromatics, i.e. at least 9% by wt., with high sulfur and nitrogen levels.

As Examples 1–3 illustrate, the process of the present invention can be used to treat oil stocks with high amounts of polyaromatics and aromatics, nitrogen and sulfur. The Charge Stocks of Examples 1, 2 and 3 contained aromatics of 16.5, 10.8 and 24% by weight respectively and charge stocks with even higher aromatics levels are effectively treated with this process to yield a product with a desirable substantially reduced level of aromatics. The polyaromatics content of the charge stock may be well above 9% by weight, and as high as about 15–20% by weight. The process is also effective in the treatment of oil stocks with initally high levels of nitrogen. The examples show that oil stocks with nitrogen levels of 36 ppm, 40 ppm, 64 ppm, or even much higher levels may be effectively processed by the present invention to produce a product with negligible nitrogen levels. Indeed the process is so effective that no subsequent adsorbent contact treatment is necessary.

The initial aromatics, sulfur, and nitrogen content of the charge stock of Examples 1, 2 and 3 and the aromatics, sulfur, and nitrogen content of the product resulting from the process of the present invention are summarized in TABLE 4.

TABLE 4

| Reduction in Sulfur, Nitrogen and Aromatics | | | | | | |
|---|---|---|---|---|---|---|
| | Charge Stock | Case 1 | Case 2 | Case 3 | Case 4 | Case 5 |
| Example 1 | | | | | | |
| Sulfur, ppm | 1900 | 3 | 7 | 2 | 55 | 22 |
| Nitrogen, ppm | 64 | <0.2 | <0.2 | 2.0 | <0.2 | <0.2 |
| Total Aromatics, wt. % | 16.5 | 4.3 | 5.7 | 3.8 | 7.2 | 9.7 |
| Example 2 | | | | | | |
| Sulfur, ppm | 1100 | 1 | 4 | 30 | 13 | |
| Nitrogen, ppm | 36 | <0.2 | <0.2 | <0.2 | <0.2 | |
| Total Aromatics, wt. % | 10.8 | 1.9 | 4.6 | 7.5 | 5.7 | |
| | Charge Stock | Product | | | | |
| Example 3 | | | | | | |

TABLE 4-continued

| Reduction in Sulfur, Nitrogen and Aromatics | | |
|---|---|---|
| Sulfur, ppm | 3100 | 2 |
| Nitrogen, ppm | 40 | <0.2 |
| Total Aromatics, wt. % | 24 | 3.5 |

EXAMPLE 4

A study was carried out to determine the role of temperature in the hydrotreating (HDT) of a feedstock to provide a turbine oil. Oven color tests were carried out while hydrotreating a feedstock at temperatures ranging from 550° F. to 750° F. Oven color test number (ASTM D-1500) is standard test for evaluating the stability of an oil. A sample of oil is maintained at 150° C. for three days and the color of the oil is compared with those of a standard color chart (0=clear oil, 8=darkest color oil). A higher oven color number is indicative of greater instability.

A. The hydrotreating conditions were an LHSV of about 0.3, hydrogen partial pressure of 2800 psig and a hydrogen circulation rate of about 1000 SCF to about 2000 SCF per barrel. The results showed that when the process temperature exceeded about 700° F., a significant increase in oven color test number, i.e. from 2.0 to 4.5 was observed.

B. In a second run, the conditions were according to the present invention with a hydrogen partial pressure of 2200 psig and temperatures up to 750° F.

The results are shown in TABLE 5.

TABLE 5

| OVEN COLOR TEST AND AROMATIC REMOVAL | | | | |
|---|---|---|---|---|
| | A. 2800 psig | | B. 2200 psig | |
| Temperature | Oven Color | PCT Aromatics | Oven Color | PCT Aromatics Removal |
| 550° F. | <3.5 | 18 | 3.0 | 14 |
| 600° | <2.5 | 45 | <2.0 | 35 |
| 650° | <2.0 | 63 | <2.0 | 76 |
| 700° | <2.0 | 87 | <2.0 | 84 |
| 750° | <4.5 | 89 | <3.5 | 85 |

NOTE:
This is a pilot plant study using heavy neutral oil having aromatics levels of:
Mono 17.4
Poly 16.4
33.8 (total aromatics)

This experimental data shows that when operating above 700° F., even though total aromatics removal increases with increasing temperature, the stability of the resulting lube base stock is adversely affected as indicated by a dramatic increase in oven color test number.

What is claimed is:

1. A process for obtaining a very high quality lube base stock suitable for use as a turbine oil which comprises:

(a) introducing a nitrogen-and sulfur-containing feedstock containing at least about 9% by weight polyaromatics and selected from the group consisting of a dewaxed oil obtained from refining distillate fraction and having a 60–700 SUS at 100° F. and a dewaxed oil obtained from refining vacuum resid and having a 2300–2700 SUS at 100° F., and hydrogen into a single stage hydrotreating reactor; and (b) subjecting the feedstock to hydrotreating in said reactor in the presence of a sulfided cobalt/molybdenum hydrotreating catalyst at an average reactor temperature of from about 600° to about 700° F. at a hydrogen partial pressure of from about 2000 to about 2500 psia at the reactor outlet, an LHSV of from about 0.3 to about 0.6 and a hydrogen circulation rate of from about 1000 SCF to about 2000 SCF per barrel to provide a very high quality lube base stock in which the aromatic and sulfur content is substantially reduced and the nitrogen is reduced to a negligible level.

2. The process of claim 1 wherein the sulfur content of the feedstock is at least about 100 ppm.

3. The process of claim 1 wherein the nitrogen content of the feedstock is at least about 30 ppm.

4. The process of claim 1 wherein the average reactor bed temperature is from about 600° to about 650° F.

5. The process of claim 1 wherein the feedstock is a solvent dewaxed oil.

6. The process of claim 1 wherein the feedstock is a catalytically dewaxed oil.

7. The process of claim 1 wherein the feedstock is an oil which has been dewaxed by a combination of solvent dewaxing and catalystic dewaxing operations.

8. The process of claim 1 wherein the feedstock possesses an SUS at 100° F. in the range of from about 100 to about 600.

9. The process of claim 1 in which volatiles are removed from the hydrotreated product of stem (b).

10. The process of claim 1 wherein following hydrotreating, the resulting lube base stock contains essentially no polyaromatics.

11. The process of claim 1 wherein following hydrotreating, the resulting lube base stock contains essentially no sulfur.

12. The process of claim 1 wherein following hydrotreating, the resulting lube base contains essentially no nitrogen.

13. The process of claim 1 wherein following hydrotreating, the resulting lube base stock contains essentially no polyaromatics, sulfur, and nitrogen.

14. The process of claim 1 wherein the feedstock contains up to about 20% by wt. polyaromatics.

15. The process of claim 2 wherein the feedstock contains up to about 3100 ppm sulfur.

16. The process of claim 3 wherein the feedstock contains up to about 64 ppm nitrogen.

* * * * *